US008235179B2

(12) United States Patent
Valjus et al.

(10) Patent No.: US 8,235,179 B2
(45) Date of Patent: Aug. 7, 2012

(54) ELEVATOR WITHOUT A COUNTERWEIGHT

(75) Inventors: Petteri Valjus, Helsinki (FI); Mikko Orava, Nurmijärvi (FI); Teuvo Väntänen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 525 days.

(21) Appl. No.: 11/505,845

(22) Filed: Aug. 18, 2006

(65) Prior Publication Data

US 2007/0012524 A1 Jan. 18, 2007

Related U.S. Application Data

(63) Continuation of application No. PCT/FI2005/000146, filed on Mar. 9, 2005.

(30) Foreign Application Priority Data

Mar. 22, 2004 (FI) ..... 20040435

(51) Int. Cl.
*B66B 7/10* (2006.01)
*B66B 11/08* (2006.01)

(52) U.S. Cl. ..... 187/264; 187/266

(58) Field of Classification Search ..... 187/264, 187/411, 412, 404, 266; *B66B 7/06, 7/10, B66B 11/08*

See application file for complete search history.

(56) References Cited

U.S. PATENT DOCUMENTS

| | | | | |
|---|---|---|---|---|
| 216,568 | A * | 6/1879 | Holske | 187/251 |
| 988,016 | A * | 3/1911 | Neenan | 187/264 |
| 1,132,769 | A * | 3/1915 | Gale, Sr. | 187/264 |
| 1,944,772 | A | 1/1934 | White | |
| 2,270,441 | A * | 1/1942 | Hymans | 187/264 |
| 3,174,585 | A * | 3/1965 | Tofanelli | 187/264 |
| 3,653,467 | A * | 4/1972 | Showalter | 187/265 |
| 4,502,570 | A * | 3/1985 | Westerlund | 187/264 |
| 5,398,781 | A * | 3/1995 | Biewald et al. | 187/264 |
| 5,437,347 | A * | 8/1995 | Biewald et al. | 187/264 |
| 5,513,724 | A * | 5/1996 | De Jong | 187/264 |

(Continued)

FOREIGN PATENT DOCUMENTS

| | | | |
|---|---|---|---|
| DE | 1251926 | * | 4/1965 |
| EP | 0631968 | | 9/1996 |

(Continued)

OTHER PUBLICATIONS

International Search Report (PCT/ISA/210) and (PCT/ISA/220).

*Primary Examiner* — Michael Mansen
*Assistant Examiner* — Stefan Kruer
(74) *Attorney, Agent, or Firm* — Harness, Dickey & Pierce, P.L.C.

(57) ABSTRACT

An elevator includes hoisting ropes and a compensating device. The hoisting ropes include first rope portions under a first rope tension that go upward from an elevator car and second rope portions under a different, second rope tension that go downward from the elevator car. The compensating device acts in substantially opposite directions on the first and second rope portions in order to do one or more of the following: equalize the first, second, or first and second rope tensions; compensate the rope tensions between the first and second rope tensions; equalize rope elongation in the first, second, or first and second rope portions; compensate the rope elongations between the first and second rope portions; and render a ratio of the first rope tension to the second rope tension substantially constant. The compensating device produces an auxiliary force acting substantially in a same direction as the first rope tension.

21 Claims, 4 Drawing Sheets

U.S. PATENT DOCUMENTS

| | | | | |
|---|---|---|---|---|
| 6,193,017 | B1 * | 2/2001 | Koster | 187/258 |
| 6,860,367 | B1 * | 3/2005 | Ericson | 187/265 |
| 7,207,421 | B2 * | 4/2007 | Aulanko et al. | 187/266 |
| 7,481,299 | B2 * | 1/2009 | Mustalahti et al. | 187/266 |
| 7,802,658 | B2 * | 9/2010 | Aulanko et al. | 187/266 |
| 8,118,138 | B2 * | 2/2012 | Aulanko et al. | 187/264 |
| 8,127,893 | B2 * | 3/2012 | Mustalahti et al. | 187/266 |
| 2005/0217944 | A1 * | 10/2005 | Aulanko et al. | 187/266 |
| 2005/0284705 | A1 * | 12/2005 | Aulanko et al. | 187/266 |
| 2006/0243532 | A1 * | 11/2006 | Aulanko et al. | 187/266 |
| 2006/0289246 | A1 * | 12/2006 | Aulanko et al. | 187/412 |
| 2007/0012524 | A1 * | 1/2007 | Valjus et al. | 187/412 |
| 2007/0151810 | A1 * | 7/2007 | Aulanko et al. | 187/404 |
| 2009/0114487 | A1 * | 5/2009 | Bjorni et al. | 187/412 |

FOREIGN PATENT DOCUMENTS

| | | | |
|---|---|---|---|
| EP | 0631967 | | 9/2004 |
| FR | 2823734 | A1 * | 10/2002 |
| GB | 1442584 | | 7/1976 |
| JP | 2007230662 | A * | 9/2007 |
| WO | 98/06655 | | 2/1998 |
| WO | 2004/041699 | | 5/2004 |

* cited by examiner

ELEVATOR WITHOUT A COUNTERWEIGHT

CROSS-REFERENCE TO RELATED APPLICATION(S)

This application is a continuation of PCT/FI2005/000146 filed on Mar. 9, 2005, which is an international application claiming priority from FI 20040435, filed Mar. 22, 2004, the entire contents of which are hereby incorporated by reference.

BACKGROUND

1. Field

The present invention relates to elevators, methods for forming elevators, uses of auxiliary forces in elevators.

2. Description of Related Art

One of the objectives in elevator development work is to achieve an efficient and economical utilization of building space. In recent years, this development work has produced various elevator solutions without machine room, among other things. Good examples of elevators without machine room are disclosed in specifications EP 0 631 967 (A1) and EP 0 631 968. The elevators described in these specifications are fairly efficient in respect of space utilization as they have made it possible to eliminate the space required by the elevator machine room in the building without a need to enlarge the elevator shaft. In the elevators disclosed in these specifications, the machine is compact at least in one direction, but in other directions it may have much larger dimensions than a conventional elevator machine.

In these basically good elevator solutions, the space required by and placement of the hoisting machine limits the freedom of choice in elevator lay-out solutions. Some space is needed to provide for the passage of the hoisting ropes. It is difficult to reduce the space required by the elevator car itself on its track and likewise the space required by the counterweight, at least at a reasonable cost and without impairing the performance and operational quality of the elevator. In the case of a traction sheave elevator without machine room, mounting the hoisting machine in the elevator shaft is difficult, especially in a solution with machine above, because the hoisting machine is an object of fairly large size and weight. Especially in the case of larger loads, speeds and/or hoisting heights, the size and weight of the machine are a problem regarding installation, even so much so that the required machine size and weight have in practice limited the sphere of application of the concept of elevator without machine room or at least retarded the introduction of said concept in larger elevators. In modernization of elevators, the space available in the elevator shaft has often limited the sphere of application of the concept of elevator without machine room. Often, especially when hydraulic elevators have had to be modernized or replaced, it has not been practical to apply a roped elevator solution without machine room due to insufficient space in the elevator shaft, particularly when no counterweight has been used in the hydraulic elevator solution to be modernized/replaced. The drawbacks of elevators with counterweight are the cost of the counterweight and the space required for the counterweight in the elevator shaft. Drum driven elevators, which are nowadays rather seldom installed, have the drawbacks of heavy and complicated hoisting machines and their large power and/or torque requirement. Prior-art elevators without counterweight are exotic. So far it has not been technically or economically reasonable to make elevators without counterweight. One solution like this is disclosed in specification WO9806655. A recent international patent application discloses a feasible solution. In prior-art elevator solutions without counterweight, the tensioning of the hoisting rope is implemented using a weight or spring, and that is not an attractive approach to implementing the tensioning of the hoisting rope. Another problem with elevators without counterweight, when long ropes are used e.g. due to a large hoisting height or large suspension ratios used, is the compensation of rope elongations, and a further problem is how to maintain a sufficient friction between the traction sheave and the hoisting ropes. An additional problem is how to ensure the compensation and/or equalization of rope elongations and/or rope tensions, and/or how to ensure the reliability of the compensating device used. In an elevator, especially an elevator without counterweight, a further problem is uncontrolled slackening of the hoisting ropes and the risk of the ropes getting tangled in a disturbance situation.

SUMMARY

The aim of the invention is to achieve at least one the following objectives. On the one hand, it is an objective of the invention to develop the elevator without machine room so as to achieve more efficient space utilization in the building and in the elevator shaft than before. This means that the elevator should permit of being installed in a relatively narrow elevator shaft if necessary. On the other hand, it is an objective of the invention to eliminate dangerously large rope elongation. Another objective is to prevent uncontrolled slackening of the elevator hoisting ropes in a disturbance situation, such as e.g. in situations where the elevator car is driven onto the buffer or when the elevator car is stopped by the safety gear. An additional objective is to improve the reliability of the compensating device acting on the hoisting ropes and at the same time the reliability of operation of the elevator.

The elevators of the invention is are discussed below, the methods for forming elevators of the invention are discussed below, and the uses of auxiliary forces in elevators of the invention are discussed below. Some embodiments of the invention are characterized by what is disclosed in the claims. Inventive embodiments are also presented in the description part of the present application. The inventive content disclosed in the application can also be defined in other ways than is done in the claims below. The inventive content may also consist of several separate inventions, especially if the invention is considered in the light of explicit or implicit sub-tasks or in respect of advantages or sets of advantages achieved. In this case, some of the attributes contained in the claims below may be superfluous from the point of view of separate inventive concepts. The features and details of different embodiments of the invention may be applied in conjunction with other embodiments.

By applying the invention, one or more of the following advantages, among others, can be achieved:

- control of the motion of the compensating device can be implemented in an easy and reliable manner by using the invention
- the friction characteristics of the elevator, especially those of the traction sheave of the elevator are improved because the ratio $T_1/T_2$ between the rope tensions $T_1$ and $T_2$ acting over the traction sheave can be held constant more easily and accurately by means of the compensating device used in the elevator of the invention, especially in dynamic situations, and the ratio $T_1/T_2$ can be adjusted by varying the weight of a diverting pulley/diverting pulleys
- the dead load of the diverting pulley/diverting pulleys of the compensating device together with possible auxiliary weights and their suspension always tend to keep the rope force $T_2$ acting on the hoisting rope portion below the elevator car at a high tension, which leads to an improved friction between the hoisting ropes and the traction sheave, especially in a situation where the elevator starts moving after the car has been driven onto the buffer the propensity to slippage between the traction sheave and the hoisting ropes of the elevator of the invention is substantially reduced due to the improved friction characteristics achieve by means of the compensating device, when the elevator starts moving, the dynamic properties of the compensating device are better due to the force of inertia caused by the mass of the diverting pulley of the compensating device and its possible auxiliary weights and suspensions, with the result that e.g. the hoisting rope portion below the elevator car behaves in a more stable manner when the elevator starts moving the use of an additional force acting in the direction of the first rope tension $T_1$ used in the compensating device means that the additional force produced by the diverting pulley/diverting pulleys of the compensating device and their suspensions and possible auxiliary weights increases the second rope tension $T_2$ in relation to the first rope tension $T_1$, so the ratio $T_1/T_2$ is more advantageous for the operation of the elevator due to the dynamically better and more stable operation of the compensating device, an impact of the compensating device's diverting pulley of a reduced force and speed against the buffer used as a slack-rope prevention means is achieved because the impact takes place in a direction against gravity in the elevator and compensating device of the invention, the mass of the diverting pulleys of the compensating device as well as that of the possible auxiliary weights and suspensions are utilized to keep the ratio between the rope forces $T_1$ and $T_2$ better at a constant value in the elevator of the invention, creeping of the elevator car in the starting and/or stopping situation can be better prevented the use of the compensating device in the elevator reduces the risk of the hoisting ropes getting tangled with other shaft equipment in situations where uncontrolled slackening of the hoisting ropes occurs, such as situations where the elevator car is driven onto the buffer or the safety gear of the elevator is activated the service life of the elevator hoisting ropes is increased and the risk of failure is reduced as the motion of the hoisting ropes is kept better under control by the compensating device of the invention and its use the reliability of the elevator is better in the elevator of the invention and the invention makes it easy to ensure that the compensating device works in the desired manner.

The primary area of application of the invention is elevators designed for transporting people and/or freight. A normal area of application of the invention is in elevators whose speed range is about or below 1.0 m/s but may also be higher. For example, an elevator traveling at a speed of 0.6 m/s is easy to implement according to the invention.

In the elevator of the invention, normal elevator ropes, such as generally used steel wire ropes, are applicable. The elevator may use ropes of synthetic material and rope structures with a synthetic-fiber load-bearing part, such as e.g. so-called "aramid" ropes, which have recently been proposed for use in elevators. Applicable solutions are also steel-reinforced flat belts, especially because of the small deflection radius they permit. Particularly advantageously applicable for use in the elevator of the invention are elevator hoisting ropes twisted from e.g. round and strong wires. Using round wires, the rope can be twisted in many ways using wires of the same or different thicknesses. In ropes well applicable with the invention, the wire thickness is below 0.4 mm on an average. Well-suited ropes made from strong wires are those in which the average wire thickness is under 0.3 mm or even under 0.2 mm. For example, thin-wired and strong 4-mm ropes can be twisted relatively advantageously from wires such that the average wire thickness in the finished ropes is between 0.15 . . . 0.25 mm, the thinnest wires having a thickness even as small as 0.1 mm. Thin rope wires can easily be made quite strong. In the invention it is possible to use rope wires having a strength e.g. as high as about 2000 $N/mm^2$. Appropriate rope wire strengths are 2100-2700 $N/mm^2$. In principle, it is possible to use rope wires of a strength of about 3000 $N/mm^2$ or even more.

In the elevator of the invention, which preferably is an elevator without machine room, the elevator car is at least partially supported by a set of hoisting ropes. The set of hoisting ropes comprises one rope or a number of parallel ropes. The elevator has a traction sheave which moves the elevator car by means of the hoisting ropes. The elevator has hoisting rope portions going upwards and downwards from the elevator car, and the rope portions going upwards from the elevator car are under a first rope tension ($T_1$) and the rope portions going downwards from the elevator car are under a second rope tension ($T_2$). The elevator has a compensating device acting on the hoisting ropes to equalize and/or compensate the rope tension and/or rope elongation and/or to render the ratio of the first and the second rope tensions ($T_1/T_2$) substantially constant. Arranged in the compensating device is an auxiliary force acting in substantially the same direction with the first rope tension ($T_1$). The auxiliary force is used to increase the second rope tension $T_2$ in relation to the first rope tension $T_1$.

In the method of the invention, the elevator car is at least partially supported by means of a set of hoisting ropes comprising one rope or a number of parallel ropes. The elevator has a traction sheave which moves the elevator car by means of the hoisting ropes, and which elevator has hoisting rope portions going upwards and downwards from the elevator car and the rope portions going upwards from the elevator car are under a first rope tension ($T_1$) and the rope portions going downwards from the elevator car are under a second rope tension ($T_2$). The elevator has a compensating device acting on the hoisting ropes to equalize and/or compensate the rope tension and/or rope elongation and/or to render the ratio of the first and the second rope tensions ($T_1/T_2$) substantially constant. In the method of the invention, an auxiliary force acting in substantially the same direction with the first rope tension $T_1$ is produced by gravity.

By increasing the contact angle using a rope pulley that functions as a diverting pulley, the grip between the traction sheave and the hoisting ropes can be improved. This makes it possible to reduce the weight of the car and also to increase its size, thereby increasing the space saving potential of the elevator. A contact angle of over 180° between the traction sheave and the hoisting rope is achieved by using a diverting pulley or diverting pulleys. The compensating device, which compensates the rope elongation, maintains a suitable $T_1/T_2$ ratio to ensure a grip between the hoisting rope and the traction sheave that is sufficient for the operation and safety of the elevator. On the other hand, it is essential for the operation and safety of the elevator that the rope below the elevator car in an elevator solution without counterweight be kept at a sufficient tension. This can not necessarily be achieved using a spring or a simple lever, due to the motion or creeping of the elevator car as a result of elongation of the hoisting ropes.

BRIEF DESCRIPTION OF THE DRAWINGS

In the following, the invention will be described in detail with reference to a few embodiment examples and the attached drawings, wherein.

DETAILED DESCRIPTION OF EXAMPLE EMBODIMENTS

Figure 1:
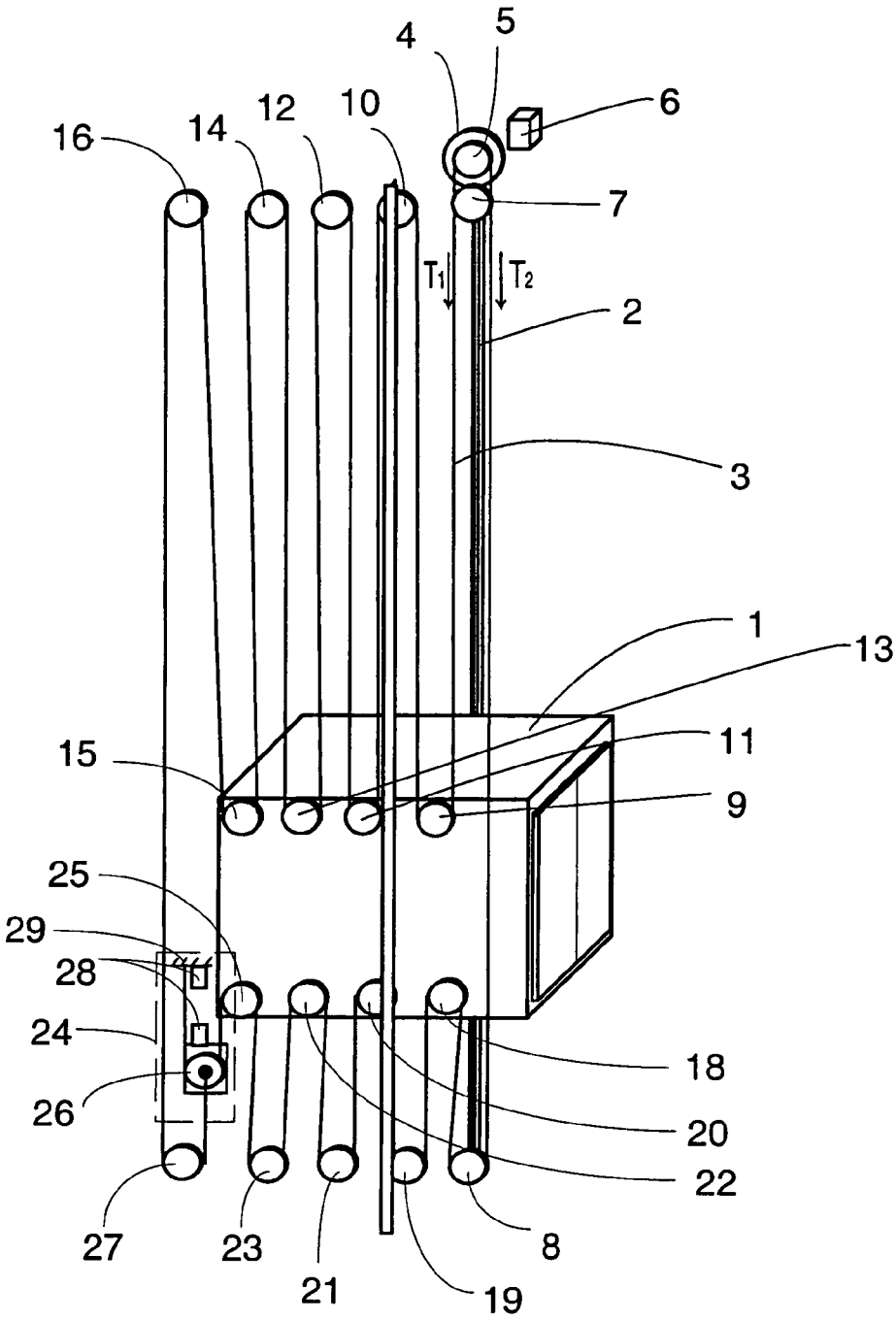
FIG. 1 is a diagram representing a traction sheave elevator without counterweight having a compensating device according to an example embodiment.

FIG. 1 presents a general illustration of a traction sheave elevator without counterweight according to the invention, provided with a compensating device according to the invention. The elevator is preferably an elevator without machine room and with the drive machine 4 placed in the elevator shaft. The elevator presented in the figure is a traction sheave elevator with machine above and without counterweight, with an elevator car 1 moving along guide rails 2. In elevators with a large hoisting height, the elongation of the hoisting rope involves a need to compensate the rope elongation, which has to be done reliably within certain allowed limit values. In respect of operation and safety of the elevator, it is essential that the hoisting rope portion below the elevator car be kept at a sufficient tension. In the rope elongation compensating device 24 presented in FIG. 1, a very long movement for compensating the rope elongation is achieved. This allows even very large rope elongations to be compensated, which is often not possible by using simple lever or spring solutions. The compensating device 24 according to the invention presented in FIG. 1 maintains a constant ratio $T_1/T_2$ between the rope tensions $T_1$ and $T_2$ acting over the traction sheave. In the case illustrated in FIG. 1, the $T_1/T_2$ ratio is 2/1. With even suspension ratios above and below the elevator car, the compensating device 24 is fitted in the elevator shaft or in some other corresponding appropriate place not in conjunction with the elevator car, and with odd suspension ratios above and below the elevator car the compensating device 24 is fitted in conjunction with the elevator car.

In FIG. 1, the hoisting ropes run as follows: One end of the hoisting ropes 3 is fixed to a diverting pulley 26 and/or its possible suspension arrangement, said diverting pulley 26 being fitted to hang on a rope portion coming downwards from a diverting pulley 25, which hoisting rope portion passes around diverting pulley 26 and goes further to the fixing point 29 of the second end of the hoisting rope 3 in the elevator shaft. The compensating device 24 is fitted in place in the elevator shaft. From diverting pulley 26, the hoisting ropes 3 go downwards and meet a diverting pulley 27 placed in the elevator shaft, preferably in the lower part of the elevator shaft below the elevator car, passing around it along rope grooves provided on the diverting pulley 27. These rope grooves may be coated or uncoated, the coating used may be, e.g., a friction-increasing material, such as polyurethane or some other appropriate material. All or some of the diverting pulleys of the elevator and/or its traction sheave may be coated with such material. From diverting pulley 27, the ropes go further upwards to a diverting pulley 16 fitted in place in the upper part of the elevator shaft, and having passed around this pulley the ropes go further downwards to a diverting pulley 15 fitted in place on the elevator car. Having passed around this diverting pulley 15, the ropes come again upwards to a diverting pulley 14 fitted in place in the upper part of the elevator shaft, pass around it and go further downwards to a diverting pulley 13 fitted in place on the elevator car. Having passed around this diverting pulley 13, the hoisting ropes 3 go further upwards to a diverting pulley 12 fitted in place in the elevator shaft, and having passed around it the ropes 3 go further downwards to diverting pulley 11 on the elevator car, pass around it an go further upwards to a diverting pulley 10 fitted in place in the upper part of the elevator shaft. Having passed around diverting pulley 10, the hoisting ropes go further downwards to a diverting pulley 9 fitted in place on the elevator car, pass around it and go further upwards in tangential contact with diverting pulley 7 to the traction sheave 5. Diverting pulley 7 is preferably fitted near and/or in conjunction with the hoisting machine 4. Common instrument panel 6 may be disposed near hoisting machine 4 and/or traction sheave 5. Between diverting pulley 7 and the traction sheave 5, the figure shows Double Wrap (DW) roping, in which roping the hoisting ropes 3 go in tangential contact with diverting pulley 7 upwards to diverting pulley 5 and, having passed around the traction sheave 5, the hoisting ropes return to diverting pulley 7, pass around it and go back to the traction sheave 5. In Double Wrap roping, when diverting pulley 7 is substantially the same size with the traction sheave 5, diverting pulley 7 may also function as a damping pulley. In this case, the ropes going from the traction sheave 5 to the elevator car 1 pass via the rope grooves of the diverting pulley 7 and the deflection of the rope caused by the diverting pulley is very small. It could be stated that the ropes going from the traction sheave 5 to the elevator car and the ropes coming to it only run in "tangential contact" with diverting pulley 7. Such "tangential contact" functions as a solution for damping vibrations of the outgoing ropes and it can also be applied in other roping solutions. An example of other roping solutions is Single Wrap (SW) roping, wherein the diverting pulley is substantially the same size with the traction sheave and the diverting pulley is used as a "tangential contact sheave" as described above. In the SW roping mentioned above, the ropes are passed only once around the traction sheave, so the contact angle of the rope on the traction sheave is about 180° and the diverting pulley is only used as an auxiliary wheel for "tangential contact" of the rope as described above and wherein the diverting pulley functions as a rope guide and a damping pulley suppressing vibrations or no diverting pulley 7 is provided at all. Diverting pulleys 16, 15, 14, 13, 12, 11, 10, 9, and 7, together with the traction sheave 5 of the hoisting machine 4, form the suspension above the elevator car, which has the same suspension ratio as the suspension below the elevator car, which suspension ratio in FIG. 1 is 8:1. The first rope tension $T_1$ acts on the hoisting rope portion above the elevator car. From the traction sheave 5, the ropes go further in tangential contact with diverting pulley 7 to diverting pulley 8, which is preferably fitted in place in the lower part of the elevator shaft. Having passed around diverting pulley 8, the ropes 3 go further upwards to a diverting pulley 18 fitted in place on the elevator car, and having passed around said diverting pulley 18 the ropes go further downwards to a diverting pulley 19 in the lower part of the elevator shaft and, having passed around this pulley, return to a diverting pulley 20 fitted in place on the elevator car. Having passed around diverting pulley 20, the hoisting ropes 3 go further downwards to a diverting pulley 21 fitted in place in the lower part of the elevator shaft, pass around it and go further upwards to a diverting pulley 22 on the elevator car. Having passed around diverting pulley 22, the hoisting ropes 3 go further downwards to a diverting pulley 23 fitted in place in the lower part of the elevator shaft, pass around it go further upwards to a diverting pulley 25 fitted in place on the elevator car, and having passed around it the hoisting ropes go further to the diverting pulley 26 of compensating device, and having passed around it the hoisting ropes go further to the fixing point 29 of their second end, which is located in a suitable place in the elevator shaft. Diverting pulleys 8, 18, 19, 20, 21, 22, 23, 25, and 26 form the suspension and rope portion below the elevator car. The second rope tension $T_2$ of the hoisting rope acts on this hoisting rope portion below the elevator car. The hoisting machine 4 and traction sheave 5 of the elevator and/or the diverting pulleys 7, 10, 12, 14, and 16 in the upper part of the elevator shaft may be mounted in place on a frame structure formed by the guide rails 2 or on a beam structure at the upper end of the elevator shaft or separately in the elevator shaft or on some other appropriate mounting arrangement. The diverting pulleys in the lower part of the elevator shaft may be mounted in place on a frame structure formed by the guide rails or to a beam structure placed at the lower end of the elevator shaft or separately in the lower part of the elevator shaft or on some other appropriate mounting arrangement. The diverting pulleys on the elevator car may be mounted in place on the frame structure of the elevator car 1 or to a beam structure or beam structures in the elevator car or separately on the elevator car or some other appropriate mounting arrangement. The diverting pulleys may also be of a modular construction, e.g., such that they are separate modular structures, such as e.g., cassette-type structures, which are fitted in place on the shaft structure of the elevator, on the structures of the elevator car and/or car frame or in some other appropriate place in the elevator shaft or in its vicinity or in conjunction with the elevator car. The diverting pulleys placed in the elevator shaft and the hoisting machine equipment and/or the diverting pulleys fitted in place in conjunction with the elevator car may be placed either all on one side of the elevator car in the space between the elevator car and the elevator shaft or in a desired manner on different sides of the elevator car.

Figure 3:
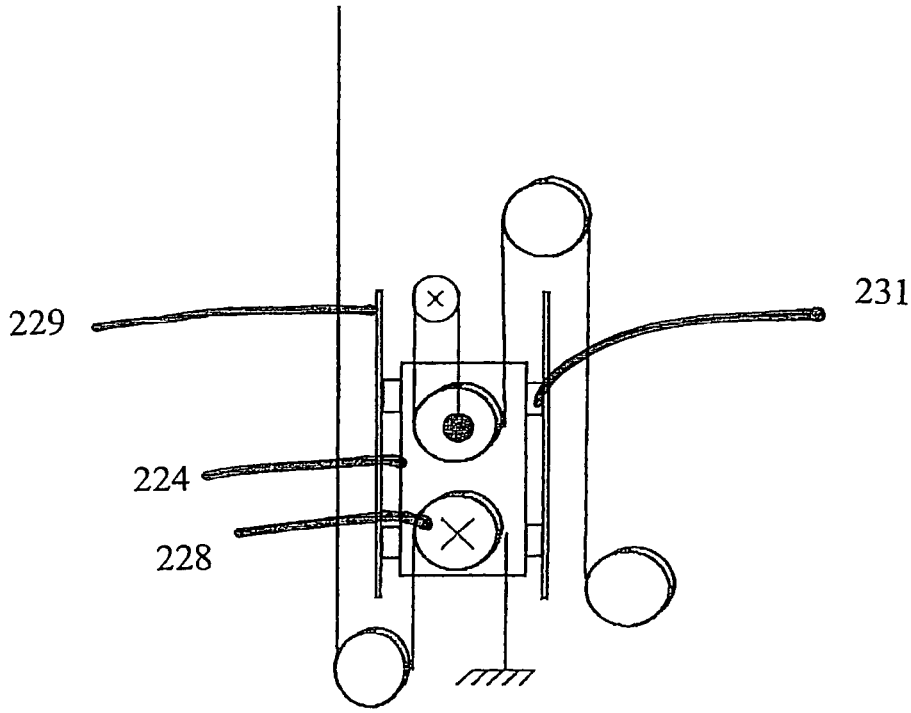
FIG. 3 is a diagram representing the compensating device according to an example embodiment.
Figure 4:
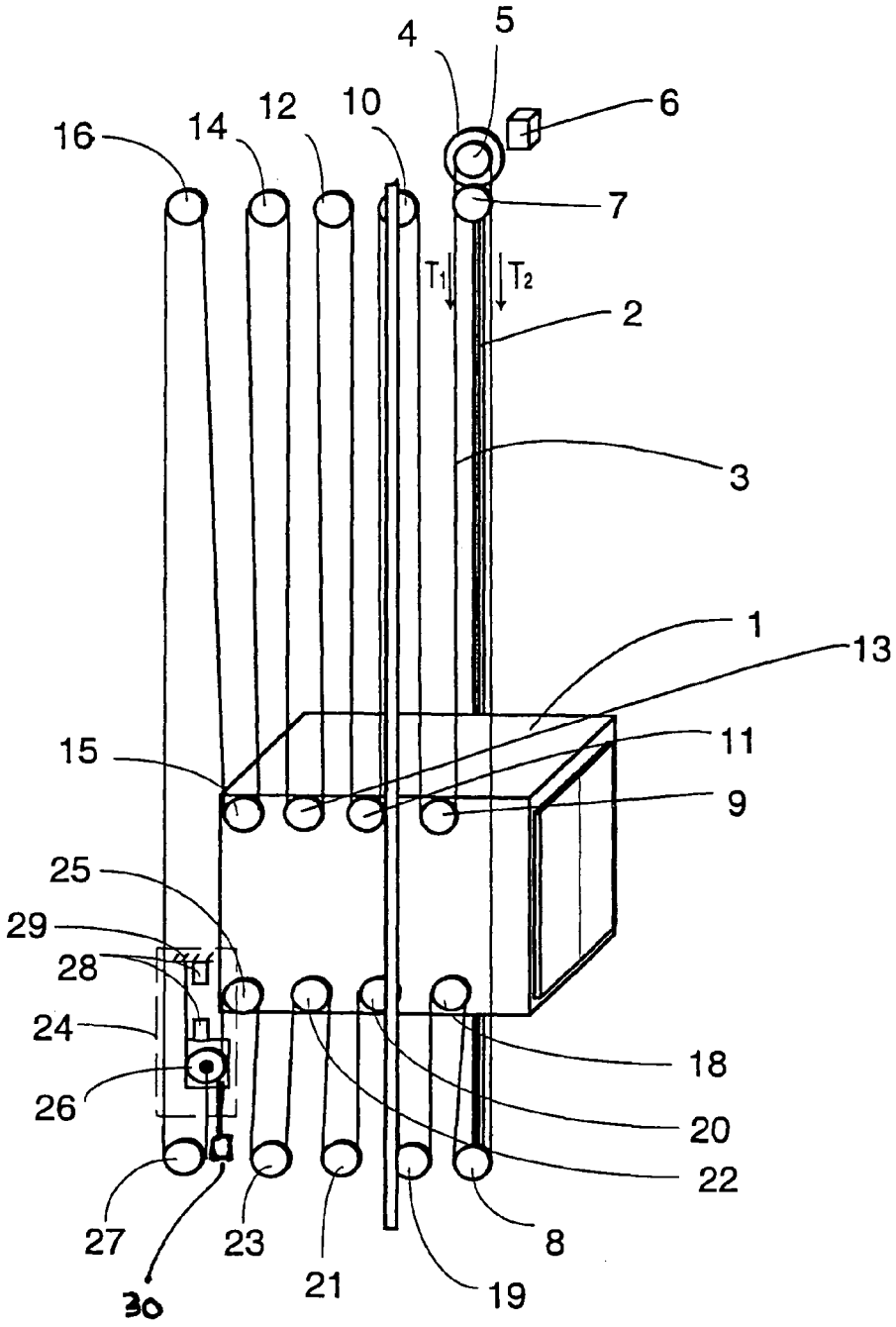
FIG. 4 is a diagram representing a traction sheave elevator without counterweight having a compensating device according to yet another example embodiment.

In the elevator presented in FIG. 1, the rope force equalizing compensating device 24 compensates rope elongations by the movement of diverting pulley 26. The diverting pulley 26 moves through a limited distance, thereby compensating elongations of the hoisting ropes 3. In addition, this arrangement keeps the rope tension over the traction sheave 5 at a constant level, so that the $T1/T_2$ ratio between the first and the second rope tensions in the situation shown in FIG. 1 is about 2/1. The diverting pulley 26, which in FIG. 1 functions as a compensating wheel, may be guided by guide rails 229 (shown in FIG. 3) to keep it on its desired track of motion, especially in situations where the compensating device 24 receives a strong impact, such as the impact occurring when the safety gear of the elevator grips. By means of the guides of the diverting pulley 26, a desired distance between the elevator car and the compensating device 24 and a controlled motion of the compensating device 24 can be maintained. The guide rails 229 of the compensating device 24 may be almost any type of guide rails applicable for the purpose, such as e.g. guide rails made of metal or some other appropriate material, e.g., guiding ropes (as shown in FIG. 3). The compensating device 24 may also include a buffer 28 fitted in it to dampen impacts against the diverting pulleys 26 of the compensating device 24 and/or to function as a device to prevent slackening of the hoisting ropes 3 due to the impacts. The buffer 28 is fitted in place so that the diverting pulley 26 remains supported by the buffer 28 before the rope elongation of the hoisting ropes has been completely discharged into the ropes, especially into the rope portion above the elevator car 1. The elevator is designed with an aim to ensure that when the normal compensation range of the compensating device 24 is exceeded, the compensating device 24 is prevented from delivering rope in the direction of the rope portions below the elevator car 1, thus maintaining a certain tension in the hoisting ropes. In the compensating device 24, use is made of the mass of the diverting pulley 26 and its suspensions as well as that of possible auxiliary weights 30 and the auxiliary force produced by them, so as to produce an auxiliary force acting in the same direction with the first rope tension $T_1$, and thus increase the tension of the rope portion below the elevator car. In other words, the second rope tension $T_2$ is increased preferably by the amount of the auxiliary force produced. The auxiliary force produced by the arrangement is preferably less than 15% of the first rope tension $T_1$, and preferable in a range of 5-10% of the first rope tension $T_1$. For example, if the total first rope tension $T_1$ is about 3000 N, then using a diverting pulley weighing about 20 kg together with its suspension and auxiliary weight 30, which produces an auxiliary force in the direction of the first rope tension $T_1$ due to gravity, the best possible advantages are achieved. The arrangement is applicable for use preferably in DW roping of the traction sheave, so as to ensure a frictional grip between the traction sheave 5 and the hoisting ropes when a compensating device 24 is used that maintains a constant $T_1/T_2$ ratio of about 2/1. Positive effects on the operation of the elevator and the compensating device 24 is already achieved by only slightly increasing the mass of the diverting pulley 26 and the suspension, e.g., by using very light auxiliary weights of even less than 3 kg. However, the auxiliary force produced by the traction sheave 5, its suspension and auxiliary weights 30 can not be increased too much in relation to the first rope tension $T_1$ (i.e., to ensure that the elevator and the compensating device 24 used will work in the desired manner), because by increasing the auxiliary force, the friction between the traction sheave 5 and the hoisting ropes is improved while the $T_1/T_2$ ratio simultaneously approaches the value 1 but the rope forces are correspondingly increased continuously. Besides by using the diverting pulleys 26 of the compensating device 24 and their suspensions, the required auxiliary force can also be produced, e.g., by replacing the auxiliary weights 30 with a spring or some other arrangement applicable for the purpose. It is possible to implement the compensating device 24 in other ways besides that described in the example, such as, e.g., by using more complex suspension arrangements, such as, e.g., by providing different suspension ratios between the diverting pulleys 26 of the compensating device 24.

Figure 2:
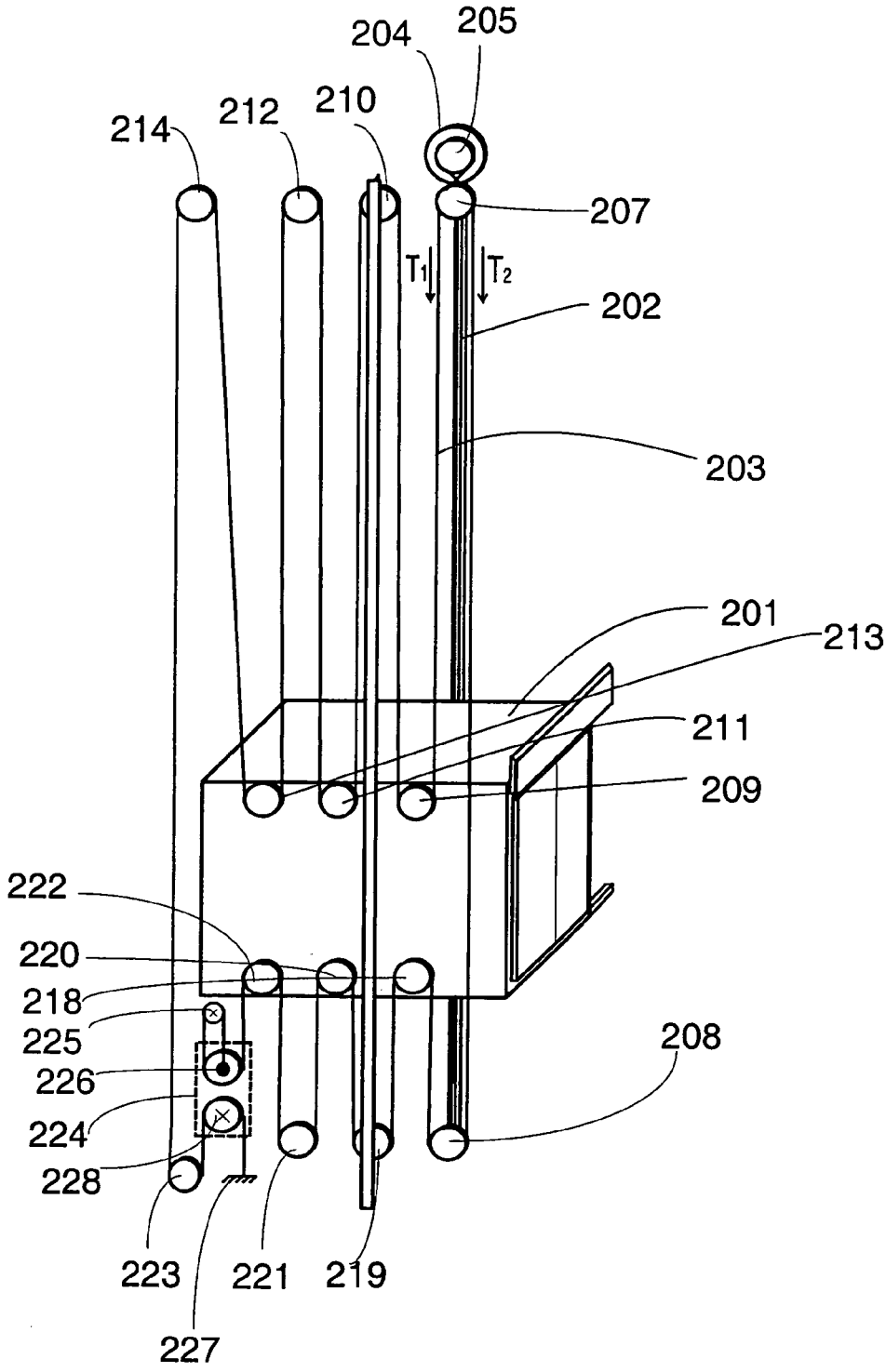
FIG. 2 is a diagram representing another a traction sheave elevator without counterweight having compensating device according to another example embodiment.

FIG. 2 presents another traction sheave elevator without counterweight according to the invention, in which elevator is also presented a second compensating device according to the invention. The elevator is preferably an elevator without machine room with a drive machine 204 placed in an elevator shaft. The elevator presented in the figure is a traction sheave elevator with machine above and without counterweight and comprises an elevator car 201 moving along guide rails 202.

In FIG. 2, the hoisting ropes 203 run as follows: One end of the hoisting ropes is secured to the elevator shaft at point 227. From the fixing point 227 in the elevator shaft, the hoisting ropes 203 go upwards and meet a diverting pulley 228 fitted in the compensating device 224 and forming part of the compensating device 224 of the elevator, and having passed around this diverting pulley 228 the hoisting ropes 203 go further downwards and meet a diverting pulley 223 placed in the elevator shaft, preferably in the lower part of the elevator shaft, below the elevator car, the rope being passed around this diverting pulley 223 along rope grooves provided on it. From diverting pulley 223, the ropes go further upwards to a diverting pulley 214 fitted in place in the upper part of the elevator shaft above the elevator car, and having passed around this diverting pulley the ropes go further downwards to a diverting pulley 213 on the elevator car, pass around it and go further upwards to a diverting pulley 212 fitted in place in the upper part of the shaft. Having passed around diverting pulley 212, the rope comes again downwards to a diverting pulley 211 fitted in place on the elevator car, and having passed around it the hoisting ropes go further upwards to a diverting pulley 210 fitted in place in the upper part of the shaft, and having passed around diverting pulley 210 the rope comes again downwards to a diverting pulley 209 mounted on the elevator car. Having passed around this diverting pulley the hoisting ropes go further upwards to a diverting pulley 207 which is preferably fitted near the hoisting machine 204 or in conjunction with it. Between diverting pulley 207 and the traction sheave 205, the figure shows X-wrap roping, wherein the hoisting rope runs crosswise with the rope portion going from the diverting pulley 207 to the traction sheave 205 and the rope portion coming back from the traction sheave 207 to the diverting pulley 207. Diverting pulleys 214, 213, 212, 211, 210, 209, and 207, together with the traction sheave 205 of the hoisting machine 204, form the suspension of the rope portion above the elevator car, in which rope portion the suspension ratio is the same as the suspension of the rope portion below the elevator car, which suspension ratio in FIG. 2 is 6:1. In FIG. 2, the hoisting rope portion above the elevator car is acted on by the first rope tension $T_1$. From diverting pulley 207, the ropes go further to a diverting pulley 208 preferably fitted in place in the lower part of the elevator shaft, e.g., on a car guide rail 202 or on the shaft floor or at some other suitable point. Having passed around diverting pulley 208, the ropes 203 go further upwards to a diverting pulley 218 fitted in place on the elevator car, and having passed around it they go further downwards to a diverting pulley 219 in the lower part of the elevator shaft, pass around it and return to a diverting pulley 220 fitted in place on the elevator car. Having passed around diverting pulley 220, the hoisting ropes 203 go further downwards to a diverting pulley 221 fitted in place in the lower part of the elevator shaft, and having passed around it the ropes go further upwards to a diverting pulley 222 fitted in place on the elevator car. Having passed around diverting pulley 222, the hoisting ropes go further to a diverting pulley 226 in the compensating device, and having passed around it the ropes 203 go further to a diverting pulley 225 fitted in place in the elevator shaft. Having passed around this pulley, the ropes come back to diverting pulley 226, to which the second end of the hoisting ropes is secured, the fixing point being preferably on the axle of the diverting pulley 226 at some other suitable point on the diverting pulley 226 or its suspension. Diverting pulleys 208, 218, 219, 220, 221, and 222, together with the diverting pulley 226 fitted in place in the compensating device 224, form the suspension of the rope portion below the elevator car, in which rope portion the suspension ratio is the same as in the suspension above the elevator car, this suspension ratio in FIG. 2 being 6:1. In FIG. 2, the rope portion below the elevator car is acted on by the second rope tension $T_2$.

FIG. 2 presents an elevator according to the invention, in which elevator are also presented a different suspension arrangement in the compensating device and a different suspension ratio and at the same time a different constant rope tension ratio than those presented in connection with FIG. 1. In FIG. 2, the compensating device 224 comprises diverting pulleys 228 and 226 immovably fitted relative to each other and preferably placed in the same suspension arrangement, such as e.g. a box. The motion of the compensating device 224 compensates rope elongations and maintains a constant ratio between the rope tensions $T_1$ and $T_2$ acting over the traction sheave. The compensating device 224 presented in FIG. 2 keeps the $T_1/T_2$ ratio between the first and the second rope tensions at about 3/2, due to the suspension arrangement presented with the compensating device 224 in the figure. The suspension ratio of the compensating device in FIG. 2 is 3/2, from which also follows the ratio between the rope tensions. By varying the suspension ratio of the compensating device, it is also possible to implement different ratios between the rope tensions.

A preferred embodiment of the elevator of the invention is an elevator without machine room and with machine above, which elevator has a drive machine with a coated traction sheave and thin and strong hoisting ropes of a substantially round cross-section. The contact angle of the hoisting ropes on the traction sheave of the elevator is greater than 180° and is preferably implemented using DW roping in the hoisting machine, which hoisting machine comprises a traction sheave and a diverting pulley, and in which machine the traction sheave and the diverting pulley are prefitted in a correct angle relative to each other. This hoisting machine is fitted in place on the elevator guide rails. The elevator is implemented without counterweight with a suspension ratio of 8:1 in such manner that both the suspension ratio of the ropes below the elevator car and the suspension ratio of the ropes above the elevator car are 8:1, and that the ropes of the elevator run in the space between one of the walls of the elevator car and the wall of the elevator shaft. The elevator has a compensating device that keeps the ratio between the rope tensions $T_1/T_2$ as a constant ratio of about 2:1. The compensation distance required by the compensating device used about equals the distance corresponding to the elongation of the rope. The compensating device of the elevator is provided with at least one slackening prevention unit for preventing uncontrolled slackening of the hoisting ropes and/or uncontrolled motion of the compensating device, said slackening prevention unit being preferably a buffer. The compensating device utilizes an auxiliary force generated by the masses of the diverting pulley and its suspension and of auxiliary weights connected to the diverting pulley, which auxiliary force acts substantially in the same direction with the first rope tension $T_1$ and which auxiliary force increases rope tension $T_2$, so that a more advantageous $T_1/T_2$ ratio is obtained.

Another preferred embodiment of the elevator of the invention is an elevator without counterweight in which the suspension ratio above and below the elevator car is 10:1. This embodiment uses conventional elevator ropes, which preferably are ropes of a diameter of 8 mm, and a traction sheave made of cast iron at least in the area of the rope grooves. The traction sheave has undercut rope grooves and the contact angle on the traction sheave has been fitted by means of a diverting pulley to be 180° or greater. When conventional 8-mm ropes are used, the traction sheave preferably has a diameter of 340 mm. The diverting pulleys used are large rope sheaves which, when conventional 8-mm hoisting ropes are used, have a diameter of 320, 330 340 mm or even more. The elevator is provided with a compensating device according to the invention.

It is obvious to the person skilled in the art that different embodiments of the invention are not limited to the examples described above, but that they may be varied within the scope of the claims presented below. For example, the number of times the hoisting ropes are passed between the upper part of the elevator shaft and the elevator car and between the diverting pulleys in the lower part of the elevator shaft and the elevator car may be varied so that a desired suspension ratio both above and below the elevator car is achieved. Embodiments are generally so implemented that the ropes are passed to the elevator car as many times from above as from below, so that the suspension ratios in the suspension above and below the elevator car are the same. In accordance with the examples described above, the skilled person can vary the embodiment of the invention as the traction sheaves and rope pulleys, instead of being coated metal pulleys, may also be uncoated metal pulleys or uncoated pulleys made of some other material suited to the purpose.

It is further obvious to the person skilled in the art that the traction sheaves and rope pulleys made of metal or some other material appropriate for the purpose which function as diverting pulleys and which are coated with a non-metallic material at least in the area of their grooves may be implemented using a coating material consisting of e.g. rubber, polyurethane or some other material suited to the purpose. In addition, it is obvious to the person skilled in the art that during fast movements of the compensating device, which occur e.g. in a situation where the safety gear of the elevator grips, the auxiliary force according to the invention also produces in the rope force an inertia mass term that tends to resist the motion of the compensating device. The greater is the acceleration of the diverting pulley/diverting pulleys and possible auxiliary weights of the compensating device, the greater is the significance of the inertia mass caused by them and tending to resist the motion of the compensating device and reduce the impact against the buffer of the compensating device, because the motion of the compensating device takes place against the force of gravity.

It is obvious to the skilled person that the elevator of the invention can be implemented using as hoisting ropes almost any flexible hoisting means, e.g. a flexible rope of one or more strands, a flat belt, a cogged belt, a trapezoidal belt or some other type of belt suited to the purpose. It is obvious to the skilled person that, instead of using ropes with a filler, the invention can be implemented using ropes without a filler, which are either lubricated or unlubricated. In addition, it is also obvious to the skilled person that the ropes may be twisted in many different ways.

It is also obvious to the person skilled in the art that the elevator of the invention can be implemented using other types of roping between the traction sheave and the diverting pulley/diverting pulleys to increase the contact angle $\alpha$ than the roping arrangements described above as examples. For example, it is possible to arrange the diverting pulley/diverting pulleys, traction sheave and hoisting ropes in other ways than in the roping examples presented. It is further obvious to the skilled person that the elevator of the invention may also be provided with a counterweight, in which elevator, for example, the counterweight preferably has a weight below that of the car and is suspended on separate ropes, the elevator car is supported partly by the hoisting ropes and partly by the counterweight and its roping.

Due to the bearing resistance of the rope sheaves used as diverting pulleys and the friction between the ropes and the rope sheaves and also to possible losses occurring in the compensating device, the ratio of the rope tensions may deviate somewhat from the nominal ratio of the compensating device. Even a 5-% deviation is not a significant detriment because the elevator must in any case have a certain in-built robustness.

The invention claimed is:

1. An elevator without counterweight, comprising:
- an elevator car;
- a set of hoisting ropes;
- a traction sheave; and
- a compensating device;
- wherein the elevator car is at least partially supported using the set of hoisting ropes,
- wherein the set of hoisting ropes includes at least one rope or a number of parallel ropes,
- wherein the traction sheave moves the elevator car using the set of hoisting ropes,
- wherein the set of hoisting ropes includes first and second rope portions,
- wherein the elevator car includes one or more first diverting pulleys from which the first rope portions extend upward from both sides of the one or more first diverting pulleys,
- wherein the elevator car includes one or more second diverting pulleys from which the second rope portions extend downward from both sides of the one or more second diverting pulleys,
- wherein the first rope portions are under a first rope tension,
- wherein the second rope portions are under a second rope tension that is different from the first rope tension,
- wherein the compensating device acts in substantially opposite directions on the first and second rope portions in order to do one or more of the following:
  - compensate the rope tensions between the first and second rope tensions;
  - compensate the rope elongations between the first and second rope portions; and
  - render a ratio of the first rope tension to the second rope tension substantially constant;
- wherein the compensating device produces an auxiliary force acting substantially in a same direction as the first rope tension, and
- wherein the compensating device includes:
  - a first diverting pulley, located below the elevator car, that acts directly and in the substantially opposite directions on the first and second rope portions; and
  - a buffer that dampens impacts on the first diverting pulley and reduces slackening of the set of hoisting ropes due to the impacts.

2. The elevator of claim 1, wherein the compensating device further includes a track, and
- wherein a motion of the compensating device on the track is guided by at least one of guide rails and guiding ropes.

3. The elevator of claim 2, where the guide rails are made from metallic or plastic material.

4. The elevator of claim 1, wherein the second rope tension is increased in relation to the first rope tension by utilizing the auxiliary force acting substantially in the same direction as the first rope tension.

5. The elevator of claim 1, wherein the compensating device includes an auxiliary device fitted within the elevator to produce the auxiliary force acting substantially in the same direction as the first rope tension.

6. The elevator of claim 1, wherein the auxiliary force acting substantially in the same direction as the first rope tension is produced by a gravitational force caused by a mass of the first diverting pulley.

7. The elevator of claim 1, wherein a mass moving with the first diverting pulley is increased using an auxiliary weight to produce the auxiliary force acting substantially in the same direction as the first rope tension.

8. The elevator of claim 1, wherein the compensating device includes more than one first diverting pulley.

9. The elevator of claim 1, wherein the elevator car is provided with one or more second diverting pulleys that increase a suspension ratio above the elevator car and from which the hoisting ropes go upward, and wherein the elevator car is provided with one or more third diverting pulleys that increase the suspension ratio below the elevator car and from which the hoisting ropes go downward.

10. The elevator of claim 1, wherein the elevator is without machine room.

11. The elevator of claim 1, wherein the auxiliary force acting substantially in the same direction as the first rope tension is produced by a gravitational force caused by a mass of the first diverting pulley and that of a suspension of the first diverting pulley.

12. The elevator of claim 1, wherein the first diverting pulley functions as a compensating wheel.

13. The elevator of claim 1, wherein the first diverting pulley is supported by the buffer when the rope elongation of the set of hoisting ropes has been completely discharged.

14. The elevator of claim 1, wherein the first diverting pulley, located below the elevator car, acts in the substantially opposite directions on rope portions extending from the first diverting pulley.

15. A method for forming an elevator without counterweight, the elevator comprising an elevator car, a set of hoisting ropes, a traction sheave, and a compensating device, the method comprising:

at least partially supporting the elevator car using the set of hoisting ropes;

causing the traction sheave to move the elevator car using the set of hoisting ropes; and producing an auxiliary force using the compensating device;

wherein the set of hoisting ropes includes at least one rope or a number of parallel ropes, wherein the set of hoisting ropes includes first and second rope portions, wherein the elevator car includes one or more first diverting pulleys from which the first rope portions extend upward from both sides of the one or more first diverting pulleys, wherein the elevator car includes one or more second diverting pulleys from which the second rope portions extend downward from both sides of the one or more second diverting pulleys, wherein the first rope portions are under a first rope tension, wherein the second rope portions are under a second rope tension that is different from the first rope tension, wherein the compensating device acts in substantially opposite directions on the first and second rope portions in order to do one or more of the following:

compensate the rope tensions between the first and second rope tensions;

compensate the rope elongations between the first and second rope portions; and render a ratio of the first rope tension to the second rope tension substantially constant;

wherein the auxiliary force acts substantially in a same direction as the first rope tension, and wherein the compensating device includes:

a first diverting pulley, located below the elevator car, that acts directly and in the substantially opposite directions on the first and second rope portions; and a buffer that dampens impacts on the first diverting pulley and reduces slackening of the set of hoisting ropes due to the impacts.

16. The method of claim 15, wherein the auxiliary force is caused by one or more of a mass of the first diverting pulley, a mass of suspensions of the first diverting pulley, and a mass of auxiliary weights used with the first diverting pulley.

17. The method of claim 15, wherein the auxiliary force is used to change the ratio of the first rope tension to the second rope tension.

18. The method of claim 15, wherein the elevator is without machine room.

19. The method of claim 15, wherein the first diverting pulley is supported by the buffer when the rope elongation of the set of hoisting ropes has been completely discharged.

20. Use of an auxiliary force that is produced in a compensating device of an elevator, the elevator including an elevator car and a set of hoisting ropes, and that acts substantially in a same direction of a first rope tension in the elevator, wherein the set of hoisting ropes includes first and second rope portions, wherein the elevator car includes one or more first diverting pulleys from which the first rope portions extend upward from both sides of the one or more first diverting pulleys, wherein the elevator car includes one or more second diverting pulleys from which the second rope portions extend downward from both sides of the one or more second diverting pulleys, wherein the first rope portions are under the first rope tension, wherein the second rope portions are under a second rope tension that is different from the first rope tension, wherein the compensating device acts in substantially opposite directions on the first and second rope portions in order to do one or more of the following:

compensate the rope tensions between the first and second rope tensions;

compensate the rope elongations between the first and second rope portions; and render a ratio of the first rope tension to the second rope tension substantially constant, and wherein the compensating device includes a first diverting pulley, located below the elevator car, that acts directly and in the substantially opposite directions on the first and second rope portions.

21. The use of claim 20, wherein the elevator is without machine room.

* * * * *